US006223740B1

(12) United States Patent
Kim et al.

(10) Patent No.: US 6,223,740 B1
(45) Date of Patent: May 1, 2001

(54) FUEL-FIRED FURNACE WITH SELF-COOLING DRAFT INDUCER FAN

(75) Inventors: Seung-Ho Kim, Fort Smith; Robert I. Kepesky, Greenwood; Walter S. Painter, Fort Smith, all of AR (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 09/567,974

(22) Filed: May 10, 2000

(51) Int. Cl.[7] ..... F24H 3/02

(52) U.S. Cl. ..... 126/110 R; 310/62; 310/63; 310/65; 417/368; 110/99 R

(58) Field of Search ..... 126/110 R, 99 R; 310/62, 63, 58, 85, 89, 65, 157, 52; 417/368

(56) References Cited

U.S. PATENT DOCUMENTS

| | | | | |
|---|---|---|---|---|
| 2,615,937 | * | 10/1952 | Ludwig et al. | 310/63 |
| 3,502,916 | * | 3/1970 | Stavrache et al. | 310/63 |
| 3,782,303 | | 1/1974 | Pfister et al. | 110/162 |
| 3,804,073 | | 4/1974 | Nozaki | 126/112 |
| 4,167,683 | * | 9/1979 | Hallerback et al. | 310/63 |
| 4,210,833 | | 7/1980 | Neveux | 310/58 |
| 4,689,507 | | 8/1987 | Baker et al. | 310/62 |
| 4,742,257 | * | 5/1988 | Carpenter | 310/62 |
| 4,877,984 | * | 10/1989 | Colwell et al. | 310/62 |
| 4,908,538 | * | 3/1990 | Geberth, Jr. | 310/62 |
| 5,070,772 | | 12/1991 | Guzorek | 454/16 |
| 5,375,651 | | 12/1994 | Colwell | 165/47 |
| 5,839,374 | | 11/1998 | Conner et al. | 110/162 |
| 5,883,451 | | 3/1999 | Majchrzak et al. | 310/89 |
| 5,954,488 | | 9/1999 | Graham et al. | 417/723.8 |

* cited by examiner

*Primary Examiner*—Ira S. Lazarus
*Assistant Examiner*—David Lee
(74) *Attorney, Agent, or Firm*—Konneker & Smith, P.C.

(57) ABSTRACT

A gas-fired forced draft air heating furnace is provided with a specially designed self-cooling draft inducer fan that overlies an inshot-type burner section of the furnace and is operatively supported on a heat exchanger plenum portion of the furnace housing. The fan motor is supported on an outboard housing side of the fan, and an umbrella cooling fan is coaxially secured to an outboard end of the fan drive shaft. During operation of the draft inducer fan, the umbrella fan is rotationally driven to direct a flow of ambient cooling air toward the outboard side of the draft inducer fan housing in a manner causing the air flow to sequentially contact and cool the outer shaft end bearing area, the motor windings and the inner shaft end bearing area at the outer side of the draft inducer fan housing. A baffle structure mounted on the outer draft inducer fan housing side serves to guide the cooling air flow along the inner shaft end bearing area and shield the burner flames from disruption by the cooling air flow area after it contacts the inner shaft end bearing area.

20 Claims, 3 Drawing Sheets

FUEL-FIRED FURNACE WITH SELF-COOLING DRAFT INDUCER FAN

BACKGROUND OF THE INVENTION

The present invention generally relates to fuel-fired heating appliances and, in a preferred embodiment thereof, more particularly relates to a fuel-fired, forced draft furnace having a specially designed self-cooling draft inducer fan.

In a forced draft fuel-fired heating appliance, such as a gas-fired air heating furnace, combustion products from a heat exchanger into which burner flames are injected are exhausted (after a substantial amount of heat is extracted from the combustion products by supply air passed exteriorly over the heat exchanger) from the heat exchanger by a draft inducer fan. A draft inducer fan of conventional construction and operation typically has a housing with an inlet opening formed on an inboard side thereof and mounted over a hole in a center panel portion of the furnace which forms a wall of the furnace housing portion in which the heat exchanger is disposed in the path of supply air being flowed through the furnace housing for heating therein.

An impeller wheel within the inducer fan housing is rotated by an electric motor carried by the housing and projecting outwardly from its outboard side, to draw spent combustion products into the fan housing and then discharge them to a flue structure operatively coupled to the outlet of the inducer fan. To cool the draft inducer fan motor, first and second small auxiliary cooling fans are typically connected to the drive shaft of the draft inducer fan. The first cooling fan is coaxially coupled to the inducer fan drive shaft between the electric motor and the inducer fan housing and functions, during operation of the inducer fan, to direct a cooling stream of air against the inboard shaft end bearing. The second cooling fan is coaxially coupled to the inducer fan drive shaft outboard of the electric motor and functions, during operation of the inducer fan, to direct a cooling stream of air against the motor windings and the outboard shaft end bearing.

This conventional arrangement of two auxiliary cooling fans associated with a draft inducer fan carries with it several well known problems, limitations and disadvantages. For example, this multi-fan arrangement undesirably adds to the operating noise level of the overall draft inducer fan assembly. Moreover, the previous necessity of using three fans in the overall draft inducing structure adds to the cost, complexity and space requirements for such structure. Additionally, the cooling air flow used to cool the inboard motor shaft end bearing can be deflected from the inducer fan housing against the adjacent fuel burner structures in a manner undesirably disrupting their flame patterns.

As can readily be seen from the foregoing, a need exists for an improved draft inducer fan structure that eliminates or at least substantially reduces these problems, limitations and disadvantages typically associated with conventional self-cooling draft inducer fan assemblies of the type generally described above. It is to this need that the present invention is directed.

SUMMARY OF THE INVENTION

In carrying out principles of the present invention, in accordance with a preferred embodiment thereof, fuel-fired heating apparatus, illustratively in the form of a gas-fired, forced draft air heating furnace, is provided has a wall structure defining a chamber for receiving a fluid to be heated, a heat exchanger disposed in the chamber and operative to receive a throughflow of hot combustion products and transfer combustion heat to the received fluid, and a fuel burner operative to introduce a flame and resulting hot combustion products into the heat exchanger.

According to a feature of the present invention, the fuel-fired heating apparatus is provided with a specially designed, self-cooling draft inducer fan assembly that includes a draft inducer fan, a single cooling fan, and a specially designed baffle structure.

The draft inducer fan is coupled to the heat exchanger and is operative to force therethrough combustion products received from the fuel burner. A motor outwardly projects from the housing side and is coupled to a drive shaft having outboard and inboard end portions respectively and rotationally carried by outboard and inboard bearing structures. The single cooling fan is representatively an umbrella type cooling fan and is secured to the outboard end of the drive shaft and is rotatable thereby to create a flow of cooling air which is directed toward the housing side and sequentially passes and cools the outboard bearing structure, a portion of the motor, and the inboard bearing structure. The baffle structure is associated with the housing side and is operative to receive air discharged from the cooling fan and facilitate contact between the received air and the inboard bearing structure. By virtue of the use of this baffle structure, the single cooling fan is able to cool the motor and both of the inboard and outboard bearing structures.

In a preferred embodiment of the fuel-fired heating apparatus, the draft inducer fan is disposed adjacent the fuel burner, which is illustratively an inshot-type gas burner, and the baffle structure is further operative to deflect the received air away from the fuel burner in a manner preventing the cooling air from being deflected off the fan housing in a manner impinging on and disrupting the burner flame. Illustratively, the baffle structure includes first and second nonparallel wall portions projecting in an edgewise direction outwardly from the housing side and having a gap between sections thereof through which the received air is discharged from the baffle structure in a direction generally transverse to the axis of the drive shaft.

Representatively, the first and second baffle structure wall portions are arranged in a generally V-shaped configuration and are transversely secured to a base wall section which is suitably secured to the housing side and interposed between the housing side and the inboard bearing section. The draft inducer fan is secured to the chamber wall structure of the apparatus above the fuel burner structure, and the side gap in the generally V-shaped baffle structure wall portion is arranged in a manner such that the cooling air received by the baffle structure is generally horizontally discharged from the gap.

DETAILED DESCRIPTION

Figure 2:
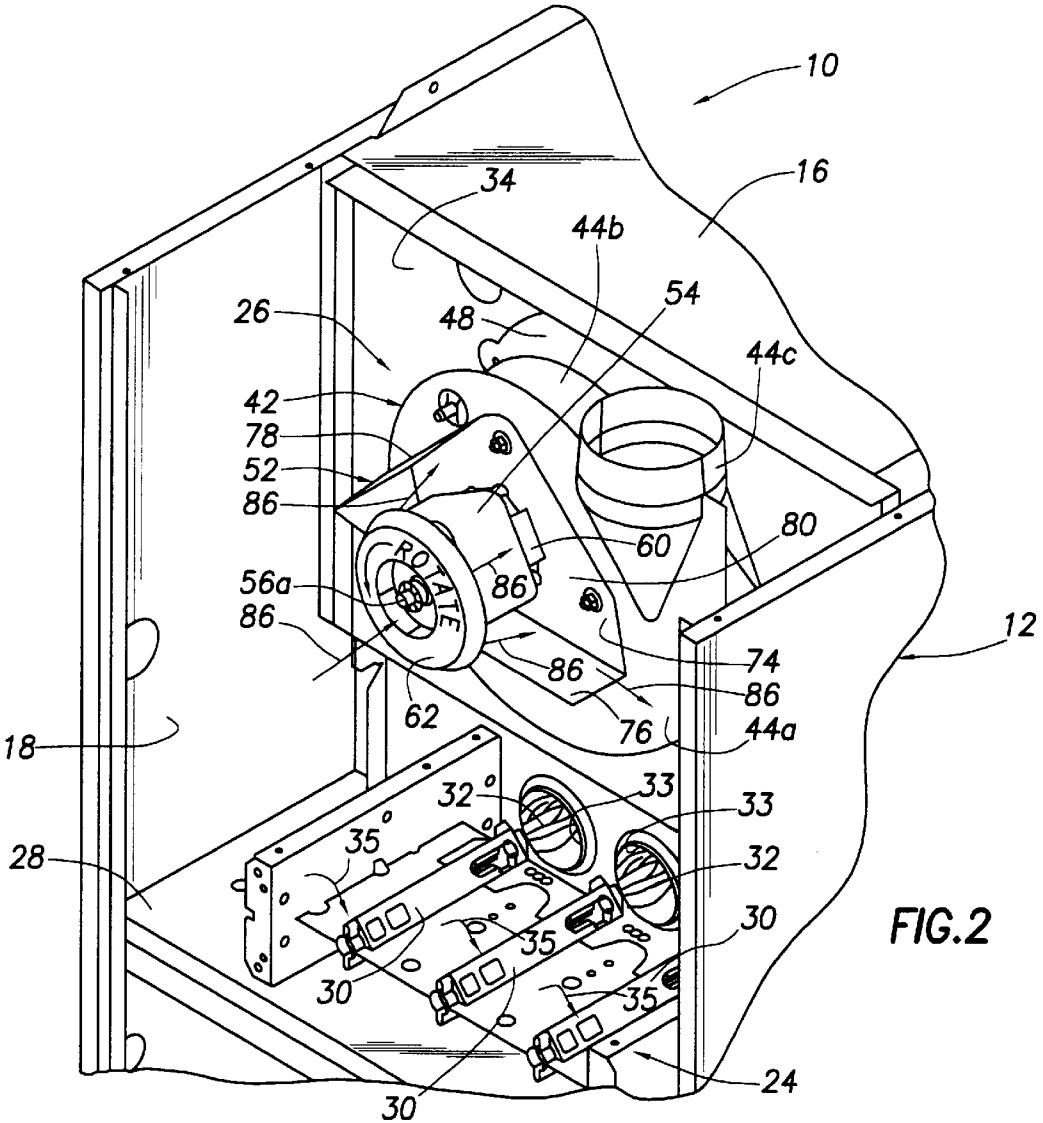
FIG. 2 is a cut away perspective view of a portion of the furnace illustrating the installed draft inducer fan and an underlying burner portion of the furnace.
Figure 1:
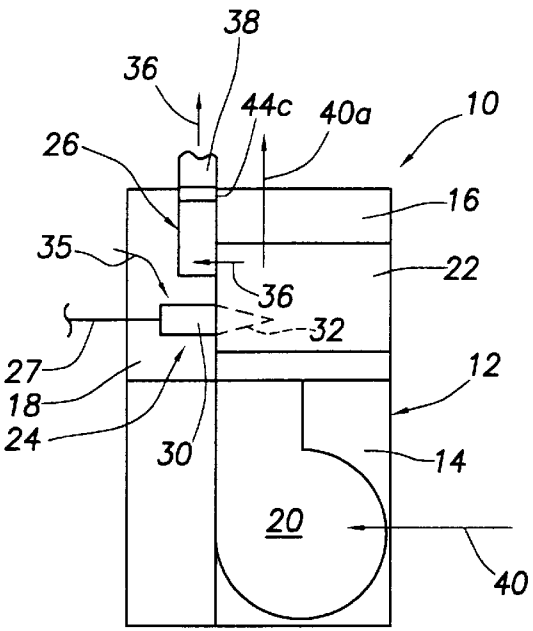
FIG. 1 is a schematic cross-sectional diagram of a representative fuel-fired, forced draft air heating furnace incorporating therein a specially designed self-cooling draft inducer fan embodying principles of the present invention.

Referring initially to FIGS. 1 and 2, the present invention provides a fuel-fired, forced draft heating appliance 10 which is representatively in the form of a gas-fired air heating furnace. Furnace 10 has a hollow housing 12 with interior supply fan, heat exchange and burner chamber portions 14,16 and 18. As viewed in FIG. 1, chamber 14 is disposed directly beneath chamber 16, and chamber 18 is to the left of chamber 16. An air supply fan 20 is disposed within the chamber 14, and a metal heat exchanger 22 is suitably supported within the chamber 16. A gas burner assembly 24 is mounted within a lower portion of the chamber 18 beneath a specially designed draft inducer fan assembly 26 that embodies principles of the present invention.

The burner assembly 24 is supplied with gas through a fuel supply line 27, is suitably supported on a bottom wall 28 of the burner chamber 18 and representatively includes inshot-type gas burners 30 operative to inject flames 32 into the interior of the heat exchanger 22 via circular holes 33 formed in the right side wall 34 of the burner chamber 18. As later described herein, the draft inducer fan assembly 26 is secured to the right side wall 34 above the burner assembly 24.

During firing of the furnace 10, the burners 30 receive adjacent ambient combustion air 35 together with gas from the supply line 27, combust the resulting air/fuel mixture, and inject the burner flames 32 into the interior of the heat exchanger 22. Spent combustion gases 36 from the interior of the heat exchanger 22 are drawn into the draft inducer fan assembly 26 and exhausted therefrom into a suitable exhaust flue structure 38. At the same time, return air 40 from the conditioned space served by the furnace 10 is drawn into the supply fan 20, discharged therefrom through the heat exchange chamber 16 exteriorly across the heat exchanger 22 therein. The air 40 flowed exteriorly along the heat exchanger 22 receives combustion heat from the heat exchanger 22 and is discharged from the furnace housing 12 in the form of heated supply air 40*a* which is appropriately delivered (for example, through a supply duct system) to the conditioned space served by the furnace 10.

Figure 3:
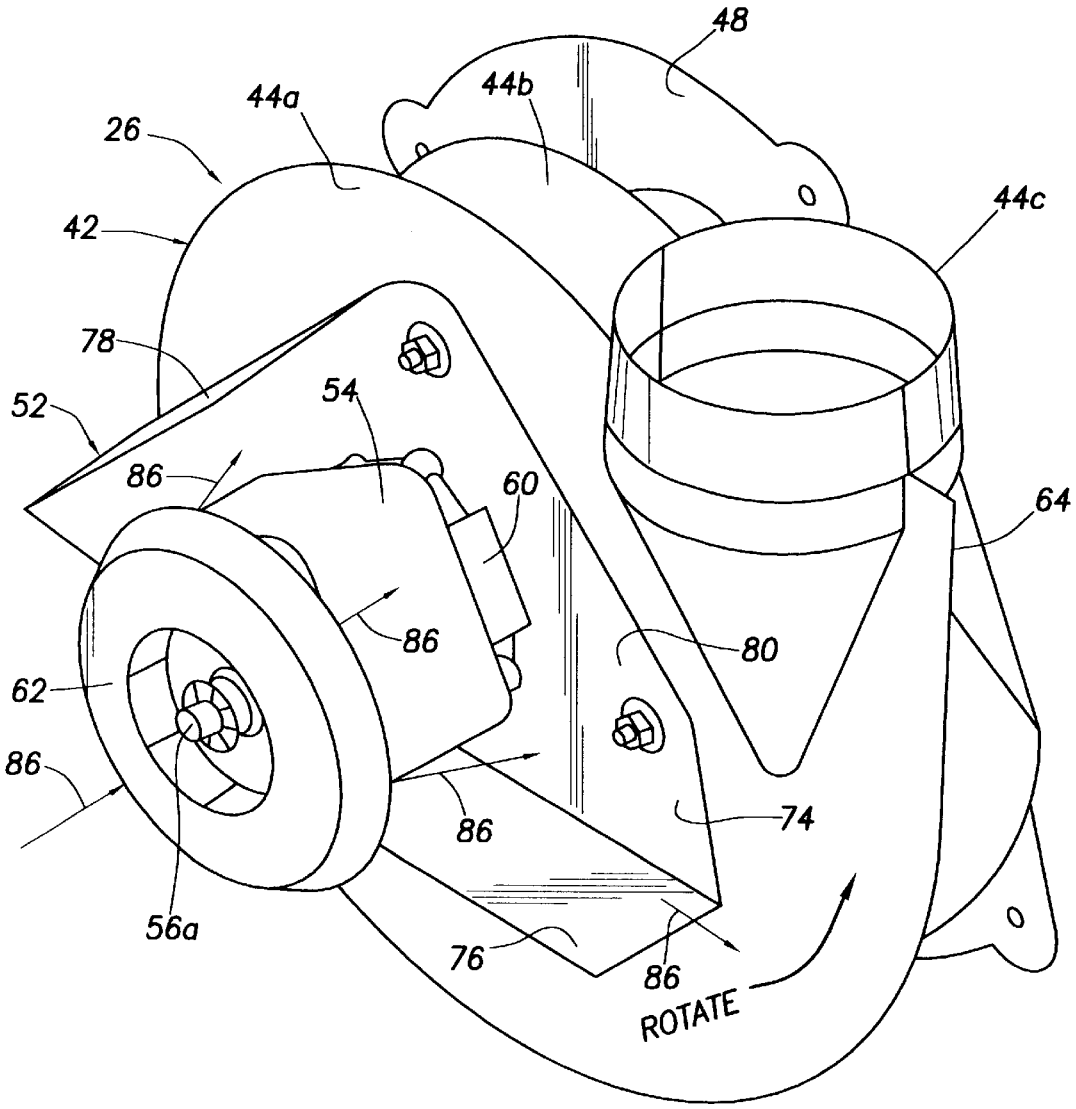
FIG. 3 is a perspective view of the assembled draft inducer fan removed from the furnace.
Figure 4:
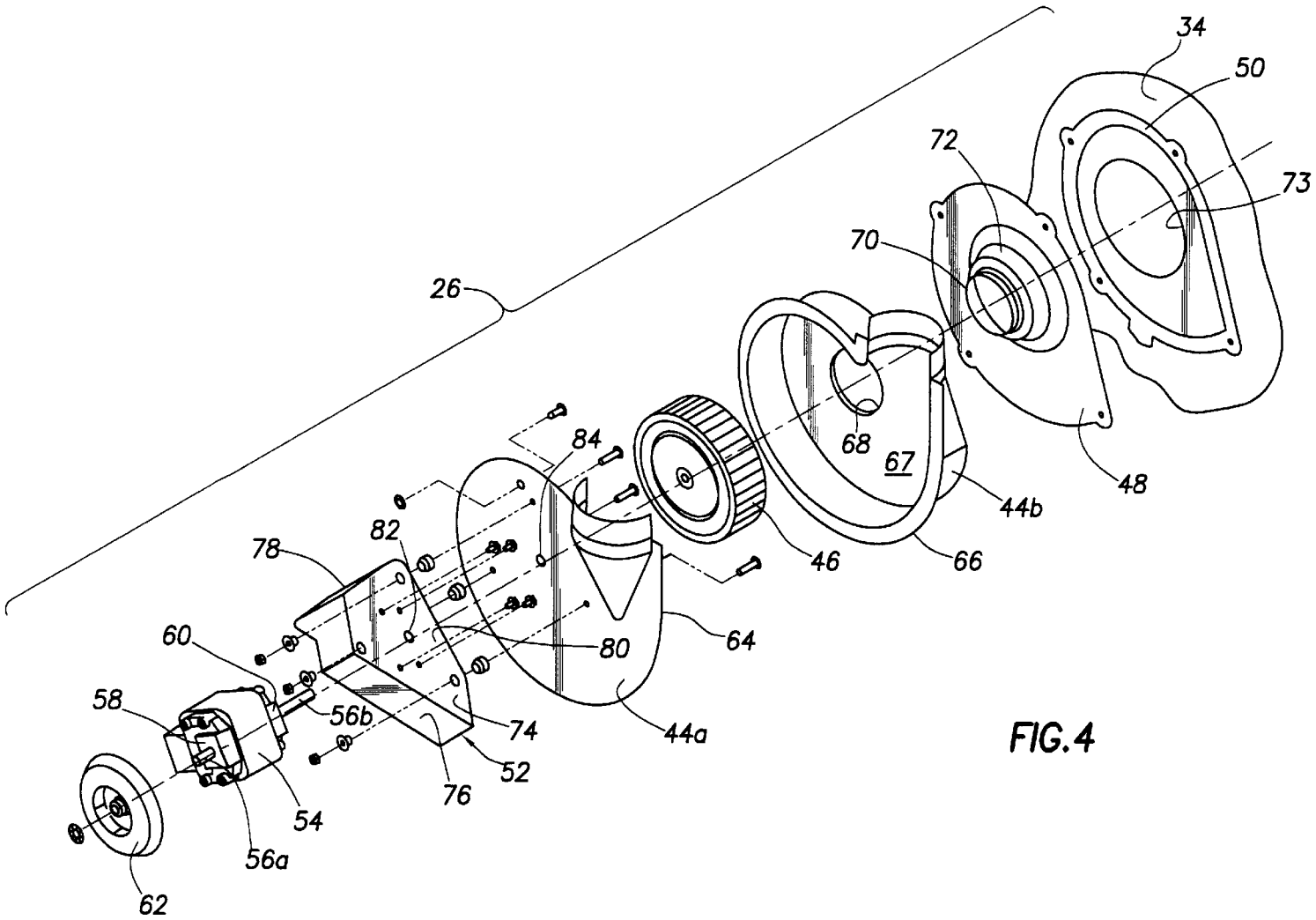
FIG. 4 is an exploded perspective view of the draft inducer fan.

Turning now to FIGS. 3 and 4, the draft inducer fan assembly 26 includes a draft inducer fan 42 having a housing 44 with outboard and inboard side portions 44*a* and 44*b*; an impeller wheel 46 rotatably disposed within the interior of the housing 44; a mounting plate 48; a sealing gasket 50; a baffle member 52; an electric drive motor 54 coupled to a drive shaft 56 having outboard and inboard ends 56*a*, 56*b* and associated outboard and inboard shaft end bearings 58 and 60; and an umbrella type auxiliary cooling fan 62.

The outboard and inboard side portions 44*a*, 44*b* of the fan housing 44 are of an aluminized steel construction, and the housing portion 44*a* has an outer peripheral side edge portion 64 which is crimped around a corresponding peripheral flange portion 66 of the housing portion 44*b* to join the two housing side portions 44*a*, 44*b* and form the housing 44. This joining of the fan housing side portions 44*a*, 44*b* forms on the housing 44 a cylindrical outlet portion 44*c* which is connected to the exhaust flue 38 (see FIG. 1). An outer side wall 67 of the housing portion 44*b* has a central inlet opening 68 therein which complementarily receives a cylindrical flange portion 70 of a hollow, circularly cross-sectioned inlet projection 72 on the outboard side of the mounting plate 48. Flange 70 is sweged around the inner side of the wall 67 of the housing portion 44*b* to anchor the mounting plate 48 to the housing portion 44*b*.

Gasket 50 is positioned against the outer side of the furnace housing wall 34, over a circular opening 73 therein, and the mounting plate 48 is suitable secured to the furnace housing wall 34 in a manner sealingly compressing the gasket 50 between the mounting plate 48 and the furnace housing wall 34 and thereby communicating the interior of the heat exchange chamber 16 (see FIGS. 1 and 2) with the interior of the draft inducer fan housing 44 via the openings 73,70 and 68. The baffle member 52 has an inner or base wall 74 with a generally V-shaped outwardly projecting peripheral portion projecting transversely thereto and defined by a bottom wall 76 joined at its left end (as viewed in FIGS. 3 and 4) to a left side wall 78 which slopes upwardly and to the right relative to the bottom wall 76 to form therewith the generally V-shaped peripheral portion of the baffle member 52. This gives the baffle member 52 an interior space that opens perpendicularly away from the base wall 74, and generally horizontally to the right through an open area or gap 80 between free outer end sections of the bottom and peripheral baffle member walls 76 and 78.

The base wall 74 of the baffle member 52 is suitably secured to the outboard side of the draft inducer fan housing portion 44*a*, and the electric drive motor 54 is anchored to the base wall 74, with the drive shaft inboard end portion 56*b* extending through aligned holes 82,84 in the base wall 74 and fan housing portion 44*a* and drivingly secured to the impeller wheel 46 rotatably disposed within the interior of the draft inducer fan housing 44. The outboard end portion 56*a* of the drive shaft 56 is coaxially and drivingly secured to the umbrella type auxiliary cooling fan 62.

During operation of the draft inducer fan assembly 26, cooling air 86 (see FIGS. 2 and 3) is drawn into the rotationally driven umbrella fan 62 and discharged toward the base wall 74 of the baffle member 52. As this discharged cooling air 86 travels toward the base wall 74 it sequentially passes along and cools (1) the outer shaft end bearing area 58 (see FIG. 4) and the windings of the electric drive motor 54, and (2) the inner shaft end bearing area 60. The baffle member 52 uniquely serves to temporarily trap this cooling air 86 discharged from the umbrella fan 62 and guide it along the inner shaft end bearing area 60 before permitting the air 86 to be horizontally discharged from the interior of the baffle member through its open right side gap 80.

The use of this specially configured baffle member 52 in place of a second auxiliary cooling fan disposed between the drive motor 54 and the draft inducer fan housing 44 provides several advantages. For example, it desirably reduces the overall operating noise of the draft inducer fan assembly 26. Additionally, it reduces both the complexity and cost of the fan assembly, Moreover, the baffle member 52, with its peripheral walls 76 and 78, desirably functions to reduce disruptions to the burner flames 32 by the cooling air 86, the baffle member 52 acting as a shield between the discharged cooling air 86 and the underlying burner flames 32 which deflects the cooling air 86 rightwardly through the open side gap 80 of the baffle member 52.

As will be readily appreciated by those of skill in this particular art, the principles of the present invention may also be utilized to advantage in a variety of fuel-fired, forced draft fluid heating appliances other than the representatively illustrated gas-fired air heating furnace 10 which utilize a draft inducer fan in conjunction with their combustion systems.

The foregoing detailed description is to be clearly understood as being given by way of illustration and example, the spirit and scope of the present invention being limited solely by the appended claims.

What is claimed is:

1. Fuel-fired heating apparatus comprising:

a wall structure defining a chamber for receiving a fluid to be heated;

a heat exchanger disposed in said chamber and operative to receive a throughflow of hot combustion products and transfer combustion heat to the received fluid;

a fuel burner operative to introduce a flame and resulting hot combustion products into said heat exchanger;

a draft inducer fan coupled to said heat exchanger and operative to force therethrough combustion products received from said fuel burner, said draft inducer fan having a housing side from which a motor outwardly projects, said motor being coupled to a drive shaft having outboard and inboard end portions respectively and rotationally carried by outboard and inboard bearing structures;

a cooling fan secured to said outboard end of said drive shaft and rotatable thereby to create a flow of cooling air which is directed toward said housing side and sequentially passes and cools said outboard bearing structure, a portion of said motor, and said inboard bearing structure; and a baffle structure associated with said housing side and operative to receive air discharged from said cooling fan and facilitate contact between the received air and said inboard bearing structure, said draft inducer fan being disposed adjacent said fuel burner, and said baffle structure being further operative to deflect the received air away from said fuel burner.

2. The fuel-fired heating apparatus of claim 1 wherein said fuel-fired heating apparatus is a fuel-fired, induced draft air heating furnace.

3. The fuel fired heating apparatus of claim 2 wherein said furnace is a gas-fired furnace.

4. The fuel-fired heating apparatus of claim 1 wherein:

said fuel burner is an inshot-type fuel burner having a flame path direction, and said baffle structure is operative to deflect the received air in a direction generally transverse to said flame direction.

5. The fuel-fired heating apparatus of claim 4 wherein:

said draft inducer fan is disposed above said fuel burner, and said baffle structure is operative to generally horizontally deflect the received air.

6. The fuel-fired heating apparatus of claim 1 wherein:

said baffle structure is further operative to deflect the received air generally transversely to the axis of said drive shaft.

7. The fuel-fired heating apparatus of claim 1 wherein:

said baffle structure includes first and second nonparallel wall portions projecting in an edgewise direction outwardly from said housing side generally parallel to the axis of said drive shaft.

8. The fuel-fired apparatus of claim 7 wherein:

said baffle structure has a gap defined between sections of said first and second wall portions.

9. The fuel-fired apparatus of claim 8 wherein:

said first and second wall portions form a generally V-shaped section of said baffle structure.

10. The fuel-fired apparatus of claim 9 wherein:

said baffle structure further includes a base wall portion to which said first and second wall portions are secured, said base wall portion extending transversely to said first and second wall portions, being secured to said housing side, and being interposed between said housing side and said inboard bearing section.

11. The fuel-fired apparatus of claim 1 wherein:

said cooling fan is an umbrella type cooling fan.

12. The fuel-fired apparatus of claim 1 wherein:

said draft inducer fan is supported on said wall structure.

13. A draft inducer fan assembly for use with a forced draft, fuel-fired heating appliance having a fuel burner, said draft inducer fan assembly comprising:

a draft inducer fan positionable adjacent the fuel burner and having:

a housing having first and second opposite sides, an impeller rotatably disposed within said housing, a motor having inboard and outboard bearing sections, and a drive shaft drivably connected to said motor, said drive shaft longitudinally projecting outwardly from said first housing side and having an inboard end portion drivingly connected to said impeller and rotatably carried by said inboard bearing section, and an outboard end portion rotatably carried by said outboard bearing section;

a cooling fan secured to said outboard end portion of said drive shaft and rotatable thereby to create a flow of cooling air which is directed toward said side portion of said housing and sequentially passes and cools said outboard bearing structure, a portion of said motor, and said inboard bearing structure; and a baffle structure associated with said first housing side and operative to receive air discharged from said cooling fan and facilitate contact between the received air and said inboard bearing structure, said baffle structure being further operative to deflect the received air away from the fuel burner.

14. The draft inducer fan assembly of claim 13 wherein:

said baffle structure is further operative to deflect the received air in a direction generally transverse to the axis of said drive shaft.

15. The draft inducer fan assembly of claim 13 wherein:

said baffle structure includes first and second nonparallel wall portions projecting in an edgewise directions outwardly from said first housing side generally parallel to the axis of said drive shaft.

16. The draft inducer fan assembly of claim 15 wherein:

said baffle structure has a gap defined between sections of said first and second wall portions.

17. The draft inducer fan assembly of claim 16 wherein:

said first and second wall portions form a generally V-shaped section of said baffle structure.

18. The draft inducer fan assembly of claim 17 wherein:

said baffle structure further includes a base wall portion to which said first and second wall portions are secured, said base wall portion extending transversely to said first and second wall portions, being secured to said first housing side, and being interposed between said first housing side and said inboard bearing section.

19. The draft inducer fan assembly of claim 13 wherein:

said cooling fan is an umbrella type cooling fan.

20. Fuel-fired heating apparatus comprising:

a wall structure defining a chamber for receiving a fluid to be heated;

a heat exchanger disposed in said chamber and operative to receive a throughflow of hot combustion products and transfer combustion heat to the received fluid;

a fuel burner operative to introduce a flame and resulting hot combustion products into said heat exchanger;

a draft inducer fan coupled to said heat exchanger and operative to force therethrough combustion products received from said fuel burner, said draft inducer fan having a housing side from which a motor outwardly projects, said motor being coupled to a drive shaft having outboard and inboard end portions respectively and rotationally carried by outboard and inboard bearing structures;

a cooling fan secured to said drive shaft and rotatable thereby to create a flow of cooling air which is directed toward said housing side and cools said outboard bearing structure, a portion of said motor, and said inboard bearing structure; and a baffle structure associated with said housing side and operative to receive air discharged from said cooling fan and facilitate contact between the received air and said inboard bearing structure;

said draft inducer fan being disposed adjacent said fuel burner, and said baffle structure being further operative to deflect the received air away from said fuel burner.

* * * * *